US005763798A

United States Patent [19]

Chen

[11] Patent Number: 5,763,798

[45] Date of Patent: Jun. 9, 1998

[54] BASE DRUM BEATER

[75] Inventor: Joseph Shao-Hung Chen, Taipei, Taiwan

[73] Assignee: Chang-Hui Chen, Taipei, Taiwan

[21] Appl. No.: 870,392

[22] Filed: Jun. 6, 1997

[51] Int. Cl.[6] ..... G10D 13/02

[52] U.S. Cl. ..... 84/422.1

[58] Field of Search ..... 84/422.1

[56] References Cited

U.S. PATENT DOCUMENTS

| | | | |
|---|---|---|---|
| 2,799,199 | 7/1957 | Dane | 84/422.1 |
| 2,896,492 | 7/1959 | Dane | 84/422.1 |
| 5,388,494 | 2/1995 | Hoshino | 84/422.1 |
| 5,557,054 | 9/1996 | Shigenaga | 84/422.1 |
| 5,610,351 | 3/1997 | Yanagisawa | 84/422.1 |

*Primary Examiner*—Michael L. Gellner
*Assistant Examiner*—Daniel Chapik
*Attorney, Agent, or Firm*—Bacon & Thomas

[57] ABSTRACT

A base drum beater including a stepped stem fastened to a pedal mechanism of a bass drum and having a front extension rod and a radial pin hole at said front extension rod, a locating pin mounted in the pin hole with its both ends projecting out of the periphery of said the extension rod of the stepped stem, two washers mounted around the front extension rod of the stepped stem, a spring mounted around the front extension rod between the washers, and a beater head mounted around the front extension rod between one washer and the locating pin and forced by the spring force of the spring into engagement with the locating pin, the beater head having a plurality of peripheral sections made of different materials that can be alternatively aimed at the base drum by turning the beater head about the front extension rod to change its angular position.

4 Claims, 5 Drawing Sheets

BASE DRUM BEATER

BACKGROUND OF THE INVENTION

The present invention relates to base drum beaters, and more particularly to such a base drum beater which can be conveniently adjusted to aim any of a plurality of beating faces of a beater head thereof at the base drum.

A regular base drum is generally equipped with a pedal mechanism and a beater driven by the pedal mechanism to beat the face of the drum. The pedal mechanism is generally comprised of two upright supports, a transverse shaft connected between the upright supports, a cam mounted on the transverse shaft, a pedal pivoted to the cam, and a return spring coupled to one end of the transverse shaft. The beater is fastened to the cam of the pedal mechanism. In order to achieve different sound effects, different beaters of different materials (wood, felt, plastic, etc.) may be alternatively used. However, it is inconvenient to remove the beater from the pedal mechanism for a change.

SUMMARY OF THE INVENTION

The present invention has been accomplished to provide a base drum beater which eliminates the aforesaid problem. According to the preferred embodiment of the present invention, the base drum beater comprises a stepped stem fastened to a pedal mechanism of a bass drum and having a front extension rod and a radial pin hole at said front extension rod, a locating pin mounted in the pin hole with its both ends projecting out of the periphery of said the extension rod of the stepped stem, two washers mounted around the front extension rod of the stepped stem, a spring mounted around the front extension rod between the washers, and a beater head mounted around the front extension rod between one washer and the locating pin and forced by the spring force of the spring into engagement with the locating pin, the beater head having a plurality of peripheral sections made of different materials, and symmetrical pairs of radial grooves which are forced into engagement with the locating pin. By changing the engagement position between the radial grooves of the beater head and the locating pin, the peripheral sections are alternatively aimed at the base drum for beating.

BRIEF DESCRIPTIONS OF THE DRAWINGS

DETAILED DESCRIPTION OF THE PREFERRED EMBODIMENT

Figure 1:
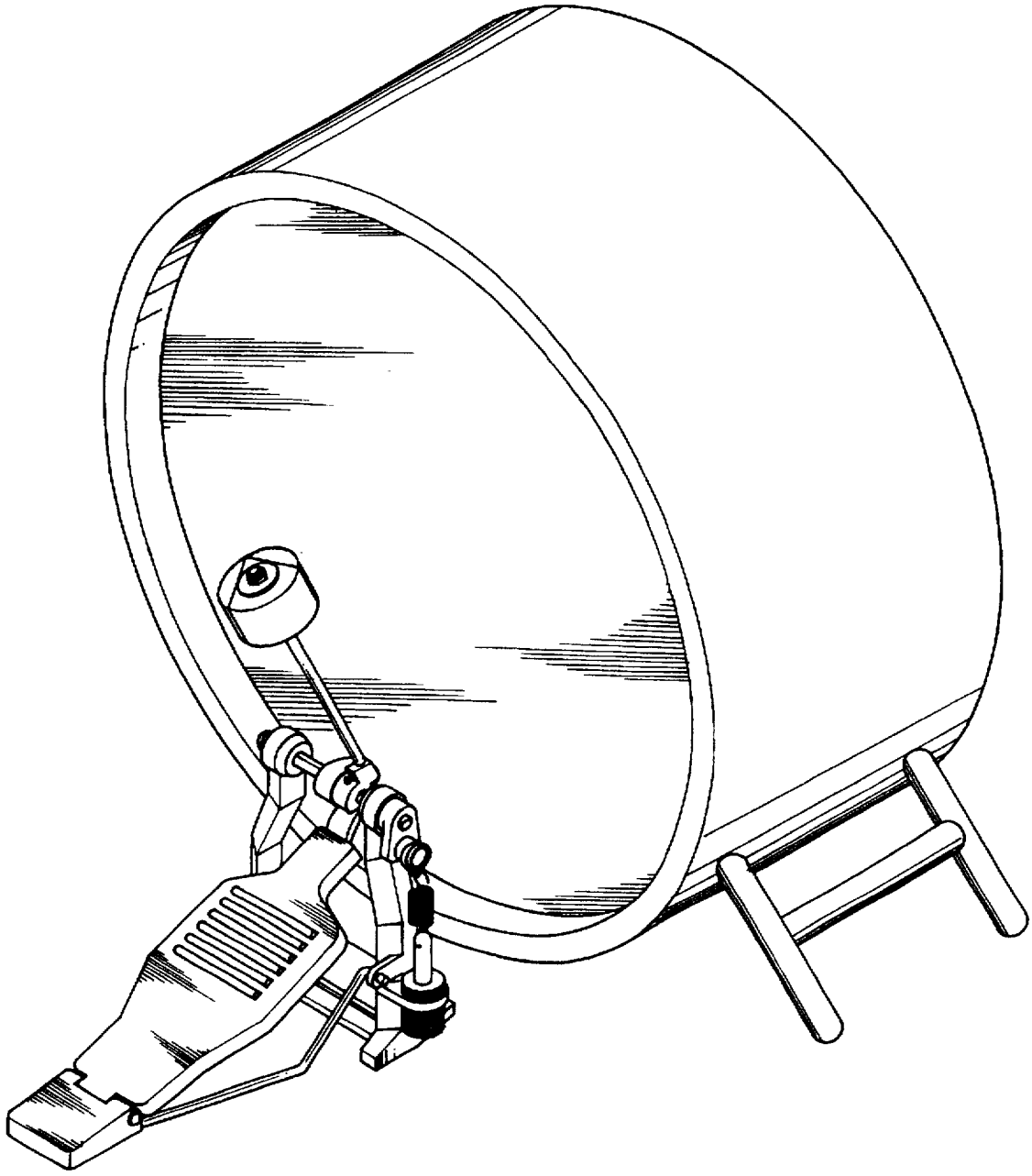
Fig. 1 PRIOR ART
FIG. 1 shows a base drum equipped with a pedal mechanism and a beater according to the prior art.
Figure 2:
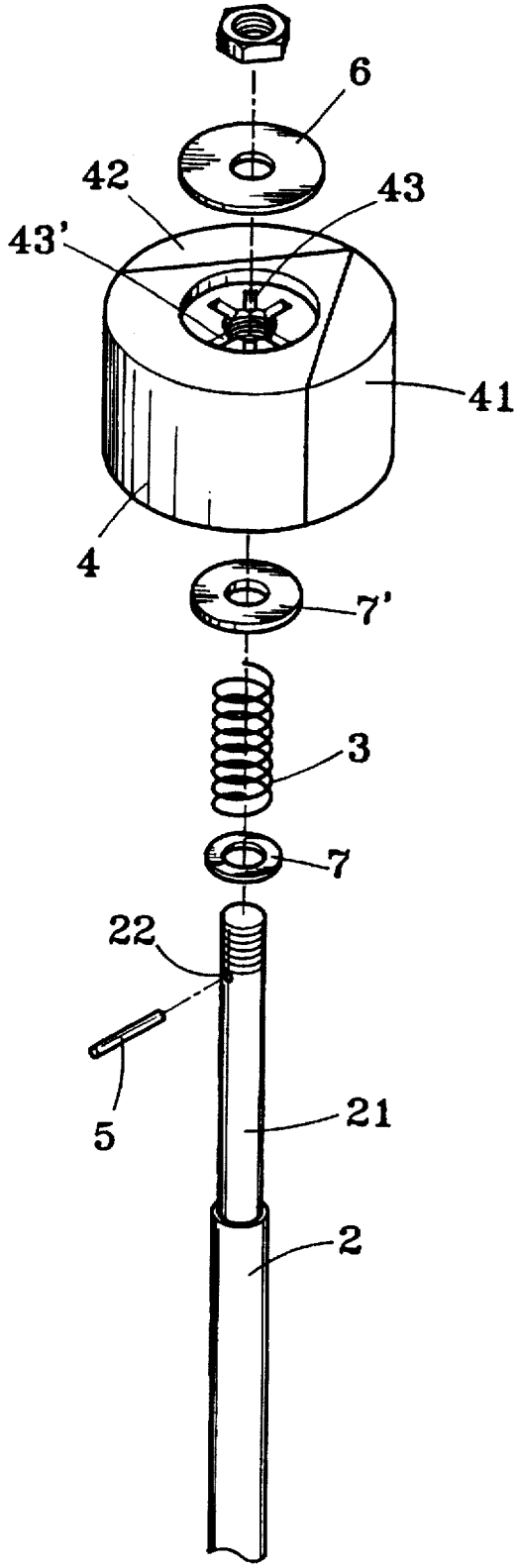
FIG. 2 is an exploded view of a base drum beater according to the present invention.
Figure 3:
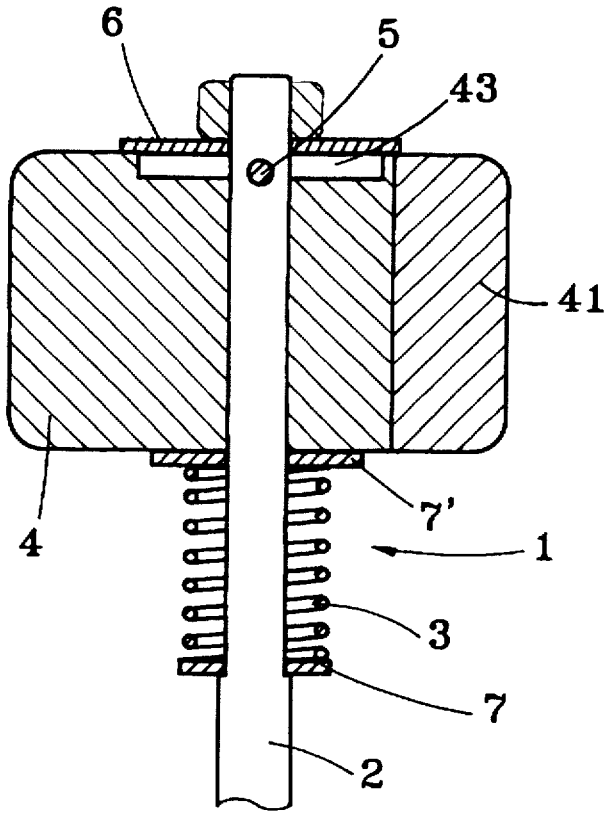
FIG. 3 is a sectional assembly view in an enlarged scale of the base drum beater shown in FIG. 2.

Referring to FIGS. 2 and 3, a beater 1 is shown comprised of a stepped stem 2 having a front extension rod 21 of relatively smaller diameter and a radial pin hole 22 at the front extension rod 21, two washers 7;7' mounted around the front extension rod 21, a spring 3 mounted around the front extension rod 21 between the washers 7;7', a locating pin 5 fastened to the pin hole 22 with its two opposite ends projecting out of the periphery of the front extension rod 21, a beater head 4 slidably mounted around the front extension rod 21 and stopped between the locating pin 5 and one washer 7', and a stop element 6 fastened to the end of the front extension rod 21 to secure the beater head 4 in place. The beater head 4 has a plurality of peripheral sections 41;42 made of different materials for example wood, felt, plastic, etc., and pairs of symmetrical radial grooves 43 at a front end thereof adapted for receiving the locating pin 5. When assembled, the spring 3 imparts an outward pressure to the beater head 4 against the stop element 6, causing the locating pin 5 to be forced into engagement with one pair of symmetrical radial groove 43.

Figure 4:
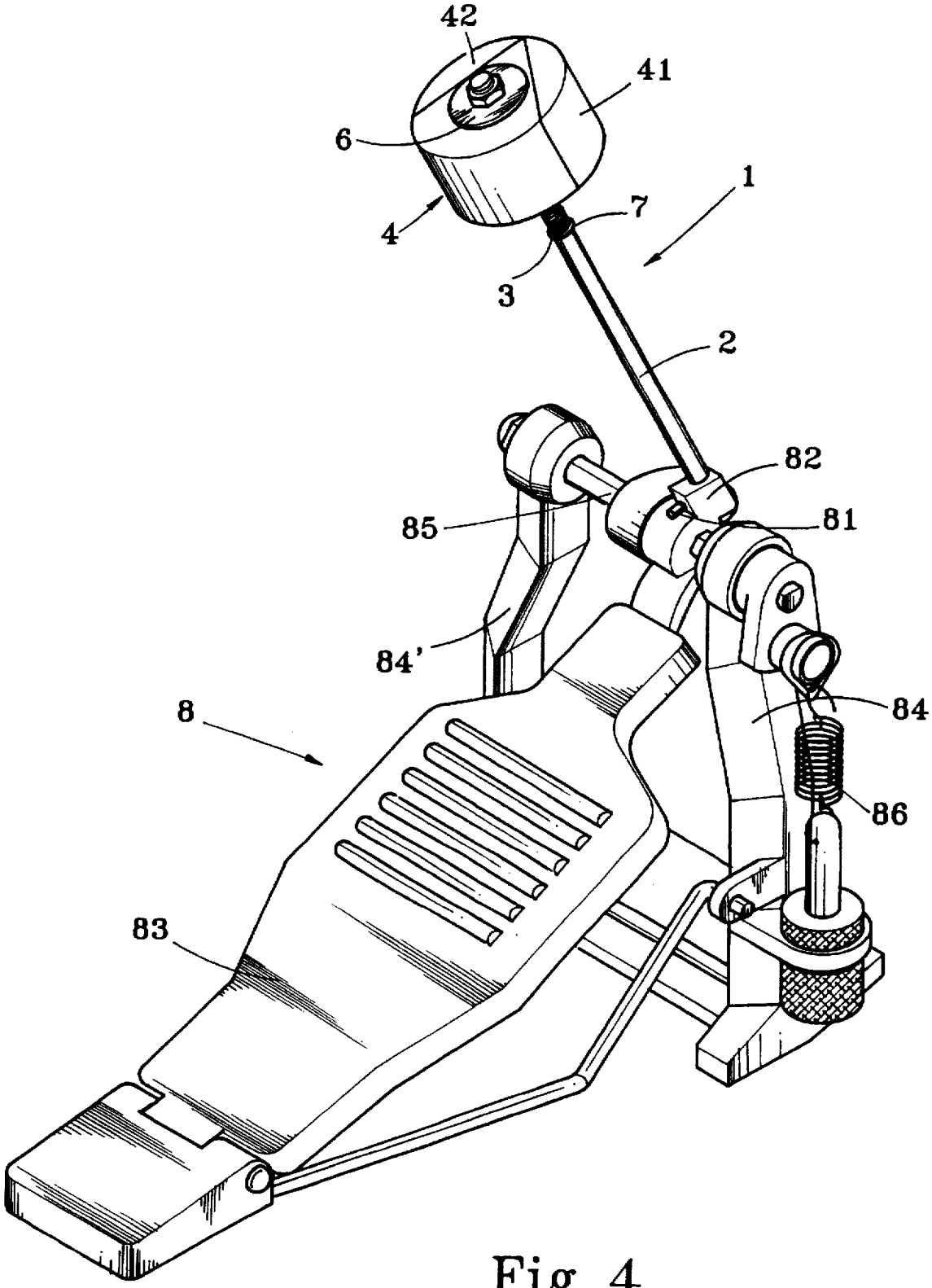
FIG. 4 is an applied view of the present invention, showing the base drum beater fastened to a pedal mechanism.

Referring to FIG. 4, the pedal mechanism, referenced by 8, comprises two upright supports 84;84', a transverse shaft 85 connected between the upright supports 84;84', a cam 82 mounted on the transverse shaft 85, a pedal 83 pivoted to the cam 82, and a return spring 86 coupled to one end of the transverse shaft 85; the stem 2 of the beater 1 is fastened to the cam 82 of the pedal mechanism 8 by a tightening up screw 81. When the pedal 83 is stepped down, the transverse shaft 85 is turned in one direction, causing the beater 1 to beat the drum (not shown). When the pedal 83 is released, the return spring 86 immediately pulls the transverse shaft 85 in the reversed direction, thereby causing the beater 1 to be moved away from the drum.

Figure 5A:
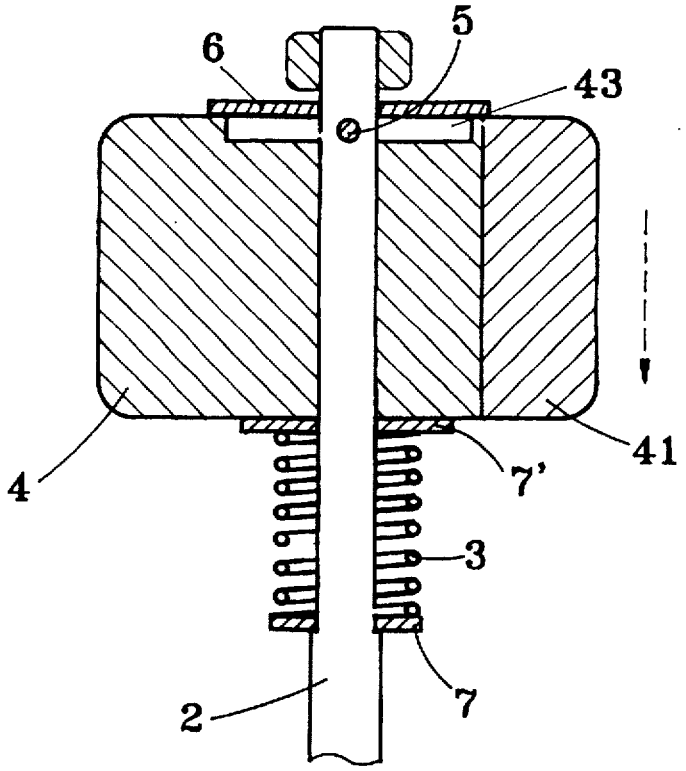
FIG. 5A is a sectional view of the present invention showing the beater head pulled downwards, the spring compressed.
Figure 5B:
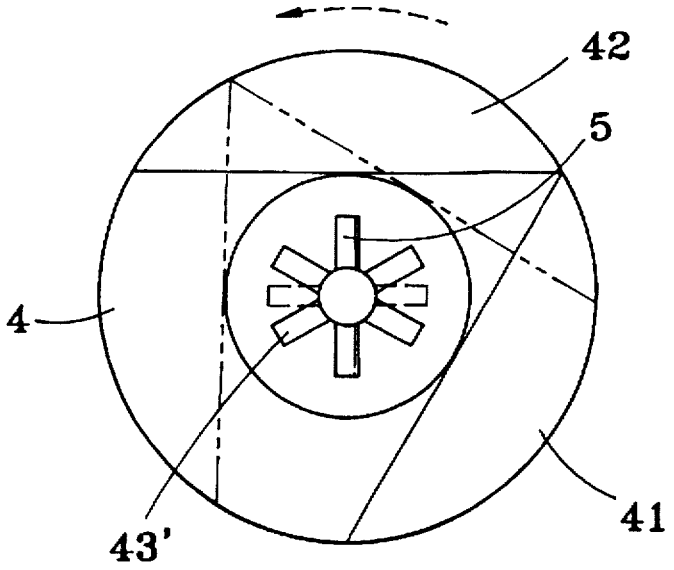
FIG. 5B is schematic drawing of the present invention, showing the beater head turned, the engagement position between the locating pin and the beat head adjusted.

Referring to FIGS. 5A and 5B, when the beater head 4 is pulled downwards from the stop element 5 to compress the spring 3, it can be turned about the stem 2 to change the angular positions of the peripheral sections 41;42, permitting one of the peripheral sections 41;42 to be aimed at the drum for beating. After adjustment, the beater head 4 is released from the hand, permitting the symmetrical pairs of the radial grooves 43;43' to be forced by the spring force of the spring 3 into engagement with the locating pin 5 again.

While only one embodiment of the present invention has been shown and described, it will be understood that various modifications and changes could be made thereunto without departing from the spirit and scope of the invention disclosed.

I claim:

1. A base drum beater comprising:

a stepped stem fastened to a pedal mechanism of a bass drum and having a front extension rod of relatively smaller diameter and a radial pin hole at said front extension rod;

a locating pin mounted in said pin-hole and having two opposite ends projecting out of the periphery of said front extension rod of said stepped stem;

a washer mounted around said front extension rod of said stepped stem, spring means mounted around said front extension rod and supported on said washer; and a beater head mounted around said front extension rod between said washer and said locating pin, said spring means imparts an outward pressure on said beater head said beater head having pairs of symmetrical radial grooves at a front end thereof adapted for receiving said locating pin.

2. The base drum beater of claim 1, wherein said beater head comprises a plurality of peripheral sections made of different materials.

3. The base drum beater of claim 1, further comprises a stop element fixedly fastened to said front extension rod of said stem at one side of said locating pin opposite to said beater head.

4. The base drum beater of claim 1 further comprising a second washer mounted around said front extension rod of said stem and stopped between said spring means and said beater head.

* * * * *